US007647909B2

(12) United States Patent
Coates

(10) Patent No.: US 7,647,909 B2
(45) Date of Patent: Jan. 19, 2010

(54) PRESSURE EQUALIZING VALVE SEAL FOR SPHERICAL ROTARY VALVE ENGINE

(76) Inventor: George J. Coates, 2100 Highway 34 & Ridgewood Rd., Wall, NJ (US) 07719

( * ) Notice: Subject to any disclaimer, the term of this patent is extended or adjusted under 35 U.S.C. 154(b) by 0 days.

(21) Appl. No.: 12/004,963

(22) Filed: Dec. 26, 2007

(65) Prior Publication Data

US 2009/0165742 A1 Jul. 2, 2009

(51) Int. Cl.
*F01L 7/16* (2006.01)

(52) U.S. Cl. ..... 123/190.14; 123/190.17

(58) Field of Classification Search ..... 123/80 BA, 123/190.8, 190.14, 190.17
See application file for complete search history.

(56) References Cited

U.S. PATENT DOCUMENTS 4,606,309 A * 8/1986 Fayard ..... 123/190.16
4,976,232 A * 12/1990 Coates ..... 123/190.17
4,989,558 A * 2/1991 Coates ..... 123/190.14
6,666,458 B2 * 12/2003 Coates ..... 277/500
6,718,933 B1 * 4/2004 Coates ..... 123/190.17
6,779,504 B2 * 8/2004 Coates ..... 123/190.14
6,880,511 B1 * 4/2005 Coates ..... 123/190.17

* cited by examiner

*Primary Examiner*—Hai H Huynh
(74) *Attorney, Agent, or Firm*—Clifford G. Frayne

(57) ABSTRACT

A valve seal for a rotary valve assembly for use in an internal combustion engine of the piston and cylinder type, the valve seal having a valve seal body member having a curved annular upper surface conforming to the spherical periphery of a spherical rotary valve, the valve seal body member having a centrally disposed aperture there through defined by an inner circular side wall, the valve seal body member further having an outer circumferential side wall having a plurality of mounting ribs for the positioning of lateral sealing rings, the valve seal body member further having a plurality of vertical axial throughbores formed between the inner circular side wall and the outer circumferential side wall for pressure equalization.

5 Claims, 3 Drawing Sheets

PRESSURE EQUALIZING VALVE SEAL FOR SPHERICAL ROTARY VALVE ENGINE

BACKGROUND OF THE INVENTION

1. Field of the Invention

The present invention relates to an internal combustion engine of the piston-cylinder type having a spherical rotary valve assembly for the introduction of the fuel/air mixture to the cylinder and the evacuation of the exhaust gases, and is particularly directed towards pressure equalizing valve seals for such rotary valve assembly.

2. Description of the Prior Art

The Applicant herein has directed considerable attention to the internal combustion engine of the piston-cylinder type and in particular to the replacement of the poppet valve system, including the poppet valve, springs, mountings and associated cam shaft, with a spherical rotary valve assembly for the introduction of the fuel air mixture into the cylinder and for the evacuation of the exhaust gases. Applicant is the named inventor in U.S. Pat. No. 4,989,576, "Internal Combustion Engine"; U.S. Pat. No. 4,944,261, "Spherical Rotary Valve Assembly for Internal Combustion Engine"; U.S. Pat. No. 4,953,527, "Spherical Rotary Valve Assembly for Internal Combustion Engine"; U.S. Pat. No. 4,976,232, "Valve Seal for Rotary Valve Engine"; U.S. Pat. No. 4,989,558, "Spherical Rotary Valve Assembly for Internal Combustion Engine"; U.S. Pat. No. 5,109,814, "Spherical Rotary Valve"; U.S. Pat. No. 5,361,739, "Spherical Rotary Valve Assembly for Use in a Rotary Valve Internal Combustion Engine"; and U.S. Pat. No. 6,308,676 B1, "Cooling System for Rotary Valve Engine". The aforementioned U.S. patents are incorporated herein as if set forth in length and in detail.

The present invention which is the subject to this application relates to the valve seal which is positioned between the spherical rotary valve and the cylinder. The upper surface of such valve seal being the surface upon which the spherical periphery of the spherical rotary valve contact during rotation.

Applicant has adapted the spherical rotary valve assembly to high compression diesel engines which operate on natural gas and which in many instances operate on natural gas directly from the well head. Due to the high compression of the engine and the combustion of unrefined natural gas, significant force is affected against the valve seal and this force is transmitted to the spherical rotary valve which in rotation contacts the upper surface of the valve seal, forming the seal. This additional force generated from the high compression and combustion of natural gas produces excessive friction and wear which is not required in order to form the seal between the spherical rotary valve and the valve seal. It is thus necessary to somehow eliminate this additional force and/or pressure or to equalize it in some manner such that it does not affect the rotation of the spherical rotary valve and its sealing contact with the upper surface of the valve seal.

OBJECTS OF THE INVENTION

An object of the present invention is to provide for a novel and improved valve seal for a rotary valve engine.

A further object of the present invention is to provide for a novel and improved valve seal for a rotary valve engine of high compression and operating on natural gas in which a pressure equalization is obtained between the combustion chamber and between the spherical rotary valve and the valve seal.

A still further object of the present invention is to provide for a novel and improved valve seal for a rotary valve engine of high compression operating on natural gas in which pressure equalization is obtained between the combustion chamber and the area between the rotary valve and the valve seal by means of a plurality of pressure equalization apertures disposed about the periphery of the valve seal and communicating between the bottom surface of the valve seal and the upper contact surface of the valve seal, thus allowing pressure equalization between the valve seal and the rotating spherical rotary valve.

A still further object of the present invention is to provide for an improved and novel valve seal for a spherical rotary valve assembly which requires no external lubrication.

SUMMARY OF THE INVENTION

A valve seal for a rotary valve assembly for use in an internal combustion engine of the piston and cylinder type, wherein the rotary valves are of a spherical section defined by two parallel planes of the sphere, the planes being disposed symmetrically about the center of this sphere defining a spherical periphery and planar end walls, the valve seal being substantially circular in cross section and having a valve seal body member having a curved annular upper surface conforming to the spherical periphery of the spherical rotary intake and spherical rotary exhaust valve, the valve seal having a centrally disposed aperture therethrough defined by an inner circular side wall coincidental with the aperture and the inlet port and outlet port, the valve seal further having an outer circumferential side wall having a plurality of mounting ribs for the positioning of lateral sealing rings, the valve seal further having a plurality of throughbores formed between the annular curved upper surface and its valve seat, thereby permitting compressed gases to pass there through and achieve pressure equalization.

BRIEF DESCRIPTION OF THE DRAWINGS

These and other advantages and improvements will be evident, especially when taken in light of the following illustrations wherein.

DETAILED DESCRIPTION OF THE INVENTION

Figure 1:
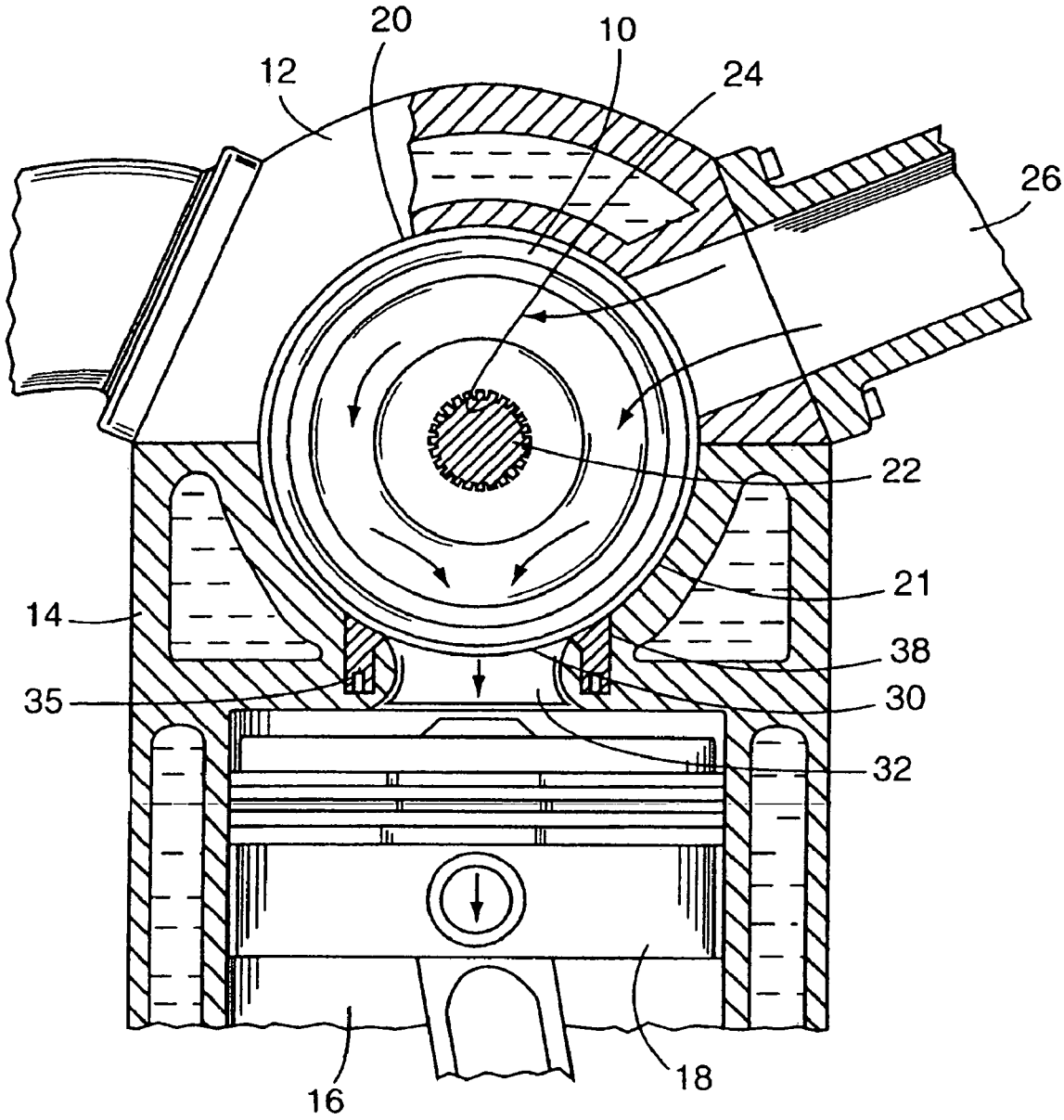
FIG. 1 is an end cross-sectional view of the head of the spherical rotary valve assembly showing the relationship of the spherical rotary valve to the cylinder, piston and valve seal.

Referring to FIG. 1, there is illustrated an end cross-sectional view of an embodiment of the spherical rotary valve assembly of Applicant's prior patents detailing the relationship between a rotary intake valve 10 enclosed within an upper half 12 and lower half 14 of a split head assembly. The split head assembly is secured to an engine block having cylinder 16 within which piston 18 reciprocates.

The split head assembly comprising upper half 12 and lower half 14 defines a drum accommodating cavity 20 within which rotary intake valve 10 is positioned. Rotary intake valve 10 is positioned on shaft 22 which passes through a centrally positioned aperture 24 on the rotary intake valve 10. As discussed in detail in Applicant's prior patents heretofore set forth, rotary intake valve 10 provides for communication between fuel air inlet port 26 and cylinder 16 by means of an aperture 30 positioned on the spherical periphery 21 of the rotary valve 10 which comes into successive registration with inlet port 32 to cylinder 16.

Rotary intake valve 10 rotating within drum accommodating cavity 20 on shaft 22 is in contact with valve seal 35, annularly positioned in an annular groove or seat 38 about inlet port 32 to cylinder 16. Valve seal 35 serves to provide a seal to insure that the fuel/air mixture passes from rotary intake valve 10 into cylinder 16 during the intake stroke and further provides a seal with rotary intake valve 10 during the compression stroke to insure that the ignition of the fuel/air mixture occurs within cylinder 16 and does not migrate into drum accommodating cavity 20. Further, seal 35 provides a seal with rotary intake valve 10 during the exhaust stroke to insure that the exhaust gases exit through the rotary exhaust valve.

The description of valve seal 35 as contained herein is made with respect to a rotary intake valve as shown and illustrated in FIG. 1. Valve seal 35 is of the same design and serves the same purpose and function with respect to its relationship to the rotary exhaust valve of the spherical rotary valve assembly as disclosed in Applicant's prior patents heretofore identified. It is further understood that each cylinder would have at least one rotary intake valve and one rotary exhaust valve and a valve seal associated with each. The improved valve seal described hereafter serves the same purpose of valve seal 35.

Figure 2:
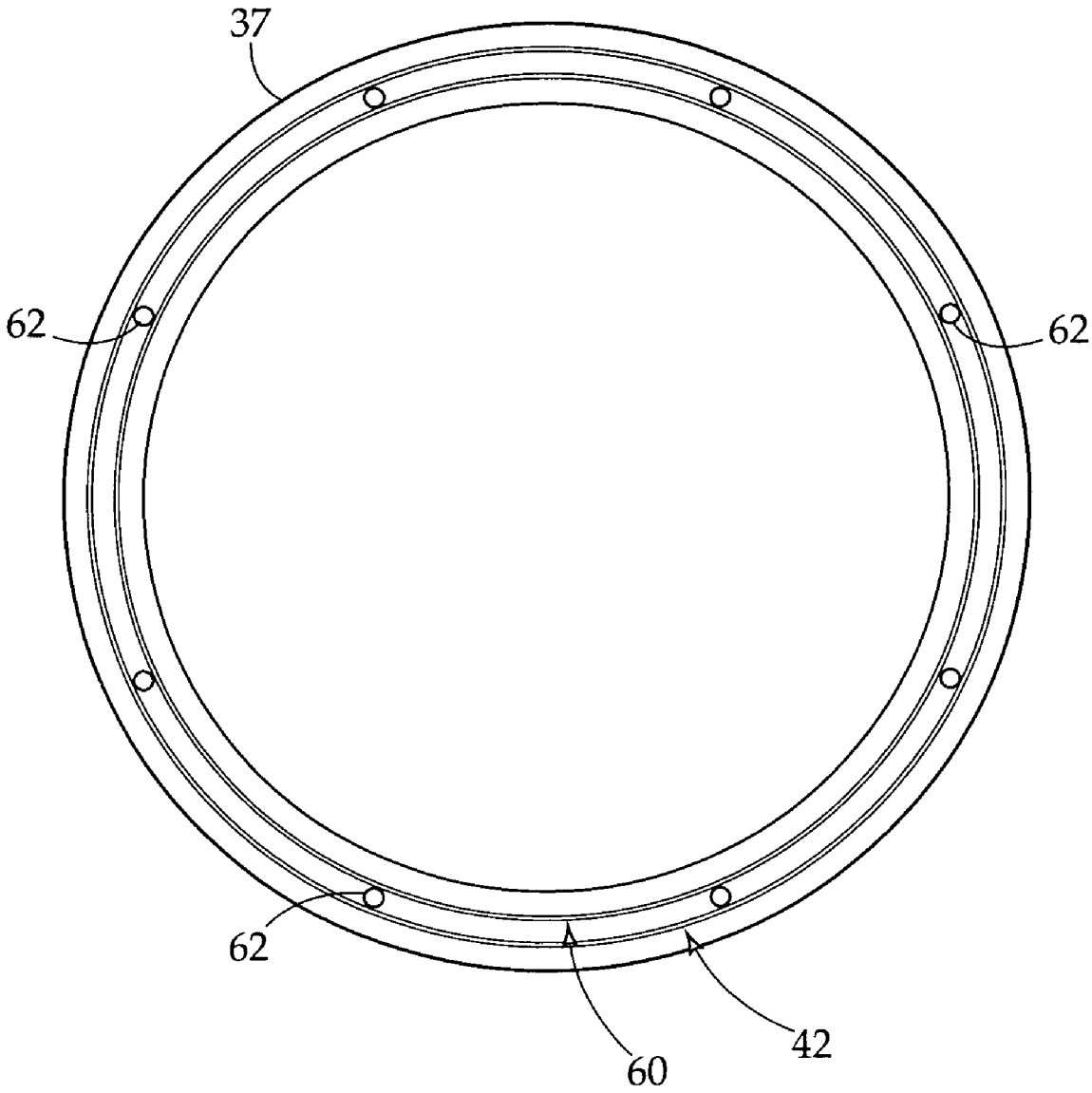
FIG. 2 is a top view of the pressure equalizing valve seal of the present invention.
Figure 3:
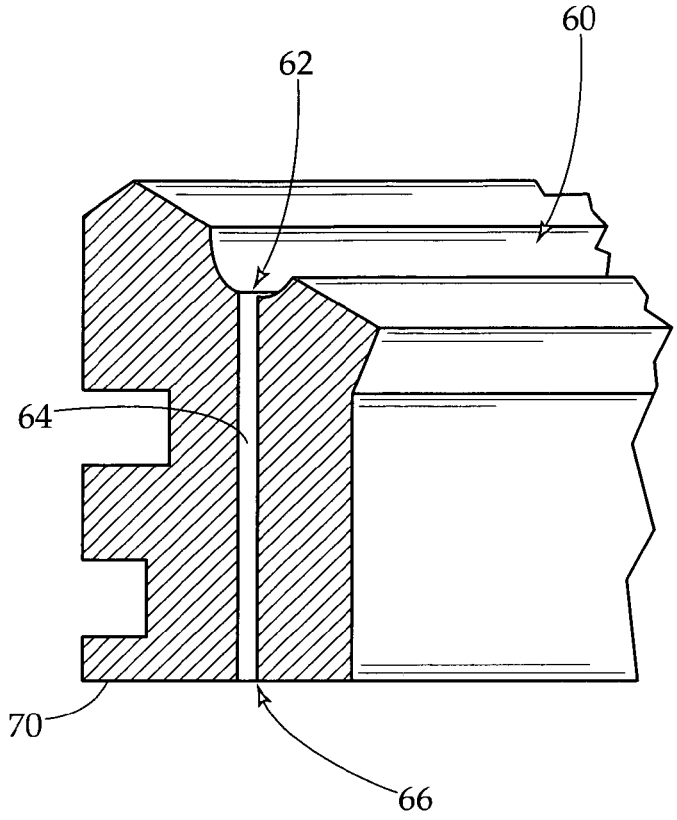
FIG. 3 is a partial side cutaway view of a first embodiment of the pressure equalizing valve seal of the present invention along plane 3-3 of FIG. 2.
Figure 4:
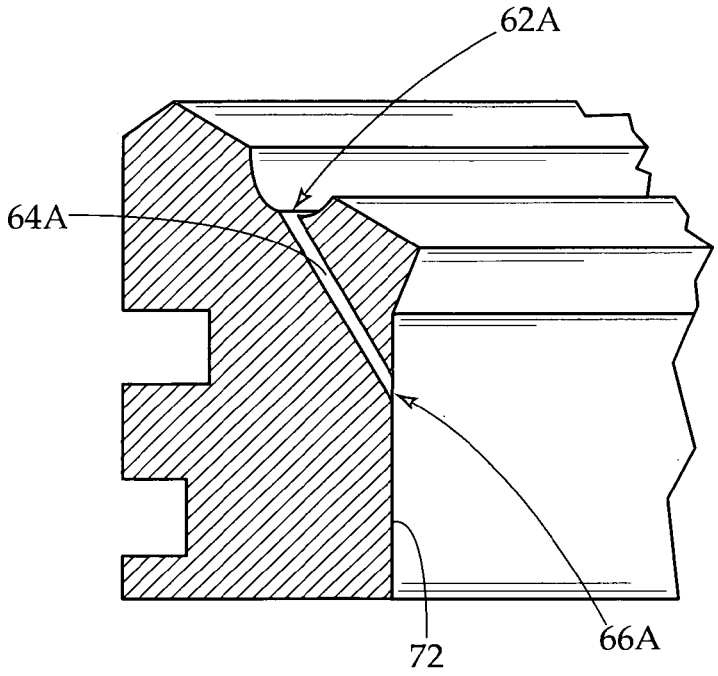
FIG. 4 is a partial side cutaway view of the pressure equalizing valve seal of the present invention along Plane 4-4 illustrating a second embodiment.

Referring now to FIGS. 2, 3 and 4, which are a top and side cutaway views of an improved valve seal 36, which is comprised of a valve seal body 37. Valve seal 36 has a centrally disposed aperture 40 alignable with inlet port 32 when valve seal 36 is seated in annular groove or seat 38. The upper annular surface 42 of valve body 37 is curved inwardly towards the center of aperture 40. This curvature corresponds to the spherical periphery curvature 23 of the rotary intake valve 10.

The outer side wall 54 of valve seal 36 is stepped and formed with a plurality of spaced apart annular ribs 56 and 57 for the receipt and positioning of a sealing or blast rings 58 and 59 which function much like a piston ring establishing a seal between valve seal 36 side wall 54 and the periphery of annular groove or seat 38 about inlet port 32. In the present embodiment there is illustrated two ribs 56 and 57 and two sealing or blast rings 58 and 59.

In the embodiment illustrated in FIG. 2, there is formed on the upper annular surface 42 of valve body 37, a groove 60 preferably of semi-circular cross section. Within this groove 60 and symmetrically disposed thereabout, are the first end terminus 62 of a plurality of throughbores 64. In one embodiment of the valve body 37 as illustrated in FIG. 3, the throughbore 64 is vertically, axially disposed having its second terminus 66 at the bottom 70 of valve body 37. In this configuration, compressed gases of the combustion chamber which are bled into the valve seat 38, are allowed to travel through throughbore 64 and into channel or groove 60 to thus equalize pressure between the valve body 37 and the spherical rotary intake or spherical rotary exhaust valve.

In the second embodiment illustrated in FIG. 4, the first terminus 62A of the throughbore 64A is in channel or groove 60. In the second embodiment, the throughbore is angularly oriented, the second terminus 66A ending on the interior side wall 72 of the valve body 37. In this embodiment there would be a plurality of throughbores symmetrically spaced about the valve body 37 in communication with channel or groove 60. The purpose of the angularly oriented throughbore 64A is the same in FIG. 4 as is in FIG. 3, and allows the compressed gases of the combustion chamber which have bled into the valve seat 38, to travel through the throughbore 64A to groove or channel 60 and thus be disbursed within groove or channel 60 thereby equalizing the pressure between the valve body 37 and the spherical rotary intake or exhaust valve.

This design enhances the sealing and seating of valve seal 36 when the piston is moving upwardly under a compression stroke. In such a situation, the rotary intake valve 10 would have rotated such that its spherical periphery 21 had closed aperture 40 of valve seal 36. The piston, under compression stroke would compress the gases within the cylinder head. The throughbores 64 allow these compressed gases to equalize pressure between sealing ring 36 and rotary valve 10.

While the present invention has been described with respect to the exemplary embodiments thereof, it will be recognized by those of ordinary skill in the art that many modifications or changes can be achieved without departing from the spirit and scope of the invention. Therefore it is manifestly intended that the invention be limited only by the scope of the claims and the equivalence thereof.

I claim:

1. A valve seal for a rotary valve assembly for use in internal combustion engines of the piston and cylinder type, the rotary valve assembly positioned within a two piece cylinder head, said cylinder head defining a plurality of drum accommodating cavities for receipt of a plurality of rotary intake valves and rotary exhaust valves, said rotary intake valves and said rotary exhaust valves having a spherical section defined by two parallel planes of the sphere, said planes being disposed symmetrically about the center of said sphere, defining a spherical periphery and planar end walls, said rotary intake valves and said rotary exhaust valves mounted on the shaft means within said drum accommodating cavities in gas tight sealing contact with an inlet port and an exhaust port respectively, said rotary intake valve and said rotary exhaust valves having passageways therethrough for the introduction and interruption of fuel air mixture to the engine and the evacuation of exhaust gases from the engine respectively, said gas tight sealing contact of said rotary intake valve and said rotary exhaust valve of said intake port and said exhaust port, respectively, accomplished by a valve seal and a valve seat, the valve seal comprising:

a valve seal body member, substantially circular in cross section, said valve seal body member having a curved annular upper surface conforming to said spherical periphery of said intake valve or said exhaust valve, said curved annular upper surface in annular groove of semi-circular cross section formed in said curved annular upper surface, said valve seal body member having an aperture therethrough defined by an inner circumferential side wall coincidental with said aperture of said inlet port or said outlet port;

said valve seal body member further having an outer circumferential side wall having formed thereon a plurality of mounting ribs for the positioning about said outer circumferential side wall of said valve seal body member of a plurality of lateral sealing rings for sealing said valve seal body member in said valve seat;

said valve seal body member having a planar bottom wall extending between said inner circular side wall and said outer circumferential side wall;

said valve seal body member further having a plurality of throughbores formed between said curved annular upper surface and said valve seat, said throughbores permitting compressed gases to exert equalizing pressure between said valve seal body member and said spherical rotary valve.

2. A valve seal for a rotary valve engine in accordance with claim 1 wherein said throughbore is vertically axially disposed between said curved annular upper surface and said planar bottom wall.

3. A valve seal for a rotary valve engine in accordance with claim 1 wherein said throughbore is angularly oriented between said curved annular upper surface and said inner circumferential side wall.

4. A valve seal for a rotary valve engine in accordance with claim 1 wherein said valve seal body member is unitarily formed from a single block of metal.

5. A valve seal for a rotary valve engine in accordance with claim 1 wherein said single block of metal is titanium.

* * * * *